US005967683A

United States Patent [19]

Fattori

[11] Patent Number: 5,967,683

[45] Date of Patent: Oct. 19, 1999

[54] VARIABLE FILL COSMETIC CONTAINER

[75] Inventor: Joseph Edward Fattori, Mendham, N.J.

[73] Assignee: Colgate-Palmolive Company, New York, N.Y.

[21] Appl. No.: 08/722,692

[22] Filed: Sep. 30, 1996

[51] Int. Cl.[6] ..... A45D 40/06; A45D 40/04

[52] U.S. Cl. ..... 401/68; 401/75; 401/86; 401/87; 401/175

[58] Field of Search ..... 401/68, 75, 79, 401/175, 86, 87; 249/102, 155, 158

[56] References Cited

U.S. PATENT DOCUMENTS

| | | | |
|---|---|---|---|
| 446,178 | 2/1891 | Barlow | 249/158 |
| 1,767,163 | 6/1930 | Ackermann | 249/102 |
| 2,032,483 | 3/1936 | Isenberg | 249/158 |
| 2,837,761 | 6/1958 | Stiegler | 249/158 X |
| 2,935,191 | 5/1960 | Leshin | 401/75 |
| 2,994,286 | 8/1961 | Mussari, Jr. | 249/155 X |
| 3,036,702 | 5/1962 | Davis . | |
| 3,212,120 | 10/1965 | Gentile | 401/175 |
| 3,443,874 | 5/1969 | Pelli et al. | 401/68 X |
| 3,671,008 | 6/1972 | Villalba, Jr. | 249/155 |
| 4,369,158 | 1/1983 | Woodruff et al. | 401/75 X |
| 4,521,127 | 6/1985 | Tomburo et al. . | |
| 4,580,920 | 4/1986 | Schmidt | 401/75 X |
| 4,664,547 | 5/1987 | Rosenwinkel | 401/175 |
| 4,915,528 | 4/1990 | Seager | 401/68 |
| 4,932,803 | 6/1990 | Goldberger et al. . | |

FOREIGN PATENT DOCUMENTS

| | | |
|---|---|---|
| 709041 | 5/1996 | European Pat. Off. . |
| 2704403 | 11/1994 | France . |
| 1557295 | 4/1973 | Germany . |
| 2807472 | 8/1979 | Germany . |
| 2258501 | 2/1993 | United Kingdom . |
| 91/08692 | 6/1991 | WIPO . |
| 94/05180 | 3/1994 | WIPO . |
| 96/12421 | 5/1996 | WIPO . |

*Primary Examiner*—Steven A. Bratlie
*Attorney, Agent, or Firm*—Michael McGreal

[57] ABSTRACT

The cosmetic container has parts that are interchangeable so that the barrel can be used to contain different fill weights. Different fill weights are used at different times such as during promotions to give about 10 to 25 percent more product. By the selection of different effective length of projections on the lower surface of the cosmetic holder and/or projections and the upper surface of the base portion of the container the distance of the cosmetic holder above the base portion at full retraction can be set to different levels. The effective length is the length that a projection maintains the base portion and cosmetic holder apart. Since the space between the cosmetic holder and the top of the barrel will be filled with product for all product amounts the cosmetic holder setting above the base portion will determine the fill amount. In the technique fewer parts need to be stocked for the differing fill levels.

18 Claims, 6 Drawing Sheets

VARIABLE FILL COSMETIC CONTAINER

FIELD OF THE INVENTION

This invention relates to a cosmetic container which through the use of modified cosmetic holder and/or base portions can be filled to different product amounts. Further, this invention relates to a method of filling cosmetic containers with a viscous, gel or solid product where the fill level can be quickly adjusted through the use of modified cosmetic holder and/or base portions.

BACKGROUND OF THE INVENTION

Cosmetic containers such as those used for deodorants, antiperspirants and lipsticks are filled with a volume of product from the top of the cosmetic holder to the top of the barrel. This product can be a paste, gel or solid cosmetic material. The cosmetic holder is moved upwardly during use to expose some of the product. When the product has been fully consumed the top of the cosmetic holder is adjacent the top of the barrel.

It is customary during promotions to fill cosmetic containers so that they contain 10 to 25 percent or more of a cosmetic product. In some instances this requires the use of different larger barrels. In other instances different cosmetic holders or other parts must be used. The problem is that each of these different parts requires a different mold. Molds are expensive. It is expensive to have different sets of molds to be used only during the times of promotions.

Additionally, it is useful if the same molds can be used to make cosmetic containers having different standard fill amounts. The objective would be to save the cost of making additional molds. That is, the same molds can be used to make products where the difference in fill amounts is only several grams. In such cases a prominent label can provide the information as to the fill amount.

This problem is solved by the present cosmetic containers. The same barrel is used for all sizes. The amount of product filled into a cosmetic container is regulated by the effective length of the projections extending downwardly from the underside of the cosmetic holder and/or upwardly from the upper surface of the base portion. This can be the actual length of the projections on the cosmetic holder or on the base portion, or ribs of different length that are a part of the cosmetic holder projections or base portion projections. The ribs change the effective length of the cosmetic holder projections or base projections. In one embodiment the effective length of these projections can be formed by the mold parts such as mold pins that are placed in the mold that makes the cosmetic holder and/or base portions and which form ribs on the base projections or cosmetic holder projections. The effective length of the projections can be of a length depending on the length of the mold pin and thus the length of the ribs. In another embodiment the length of the cosmetic holder projections or base portion projections can be varied by the use of different mold parts such as mold sleeves. Consequently, in order to produce cosmetic holders and/or base portions that have different effective length projections (and thus different fill amounts) it only is necessary to stock mold parts such as mold pins of different lengths. There is no need to stock barrels and/or cosmetic holders and/or base portions for different fill amounts. Using the present techniques through the use of different mold parts the same molds are operated to make the needed parts. The same parts are made continuously with the same molds with the only change being mold parts such as mold sleeves or mold pins. This provides a capital cost savings for molds and an operating cost savings with regard to the inventory of parts that is needed. In addition, this provides for a quick changeover to different sizes. It solves the problem of a lower cost way to make cosmetic products of different fill amounts using the same container.

BRIEF SUMMARY OF THE INVENTION

A cosmetic container can be used to hold different fill amounts using essentially the same parts for all fill amounts. This is accomplished through the use of the same barrel and a base portion having projections of different effective lengths extending from an upper surface and/or projections of a different length extending downwardly from the cosmetic holder. In order to set different fill amounts the effective lengths of the projections on the base portion and/or on the cosmetic holder are varied. The effective lengths can be changed by varying the length of the projections or by varying the length of one or more longitudinal ribs on the projections. In either case there is caused an interference with the base portion and cosmetic holder or with the interfit of the base projections and the cosmetic holder projections. For greater fill amounts the projections are of a decreased effective length, and for lesser fill amounts the projections are of an increased effective length.

In one embodiment of this invention the effective length of the projections is changed by a change in the actual length of the projections. By changing the length of the projections the distance of the cosmetic holder above the base portion can be varied when the cosmetic holder is fully retracted towards the base portion. This is the position of the cosmetic holder when the cosmetic container is being filled. This in turn will vary the volume of the product that is filled into the container.

In another embodiment the effective length of the projections is changed by the length of longitudinal ribs on the projections. By the use of ribs on the surfaces of the projections, and an interfitting arrangement of the base portion and cosmetic holder projections when the cosmetic holder is fully retracted towards the base portion, there is caused an interference in the interfit of the base portion projections and the cosmetic holder projections and thus a difference in effective lengths depending on the length of the ribs.

In either embodiment the volume of the container between the cosmetic holder and the top of the barrel is varied. This is the result in the change of the distance between the cosmetic holder and base portion when the cosmetic holder is fully retracted toward the base portion. This is the position of the elevator cosmetic holder when the cosmetic container is being filled. This is accomplished by slight mold part changes, such as different mold pins to produce ribs on the projections, when the cosmetic holder or the base portion is being made. A change in mold sleeves can produce projections of varying length. Very few additional mold parts need to be stocked and changeover from one fill amount to another fill amount can be quickly accomplished. Additional mold ribs are not needed.

In the filling of the cosmetic container the elevator cosmetic holder is retracted on the elevator screw until the cosmetic holder projections contact the base portion or the base portion projections. The contact of the cosmetic holder projections and base portion projections can be an interfitting contact, and particularly in the embodiment where longitudinal ribs on the base portion projections or the cosmetic holder projections determine the effective length of these projections. After the cosmetic holder has been fully retracted the cosmetic container above the cosmetic holder up to the top of the barrel is filled with the cosmetic product. This can be by means of a top or bottom fill technique. The cosmetic container then can be capped and can be shipped for use.

DETAILED DESCRIPTION OF THE INVENTION

The figures show a cosmetic container that is very useful for deodorants and antiperspirants. These can be solid, paste, lotion or gel deodorants or antiperspirants. The primary feature of the invention is the ability to use the same molds to make all of the container parts regardless of the fill amount. The only difference from fill amount to fill amount is the effective length of the projections on the base portion and/or the cosmetic holder. This is accomplished by the use of different mold parts in producing the base portion or the cosmetic holder. There can be a change in the actual length of the projections on the base portion or the cosmetic holder or on longitudinal ribs on these projections.

Figure 1:
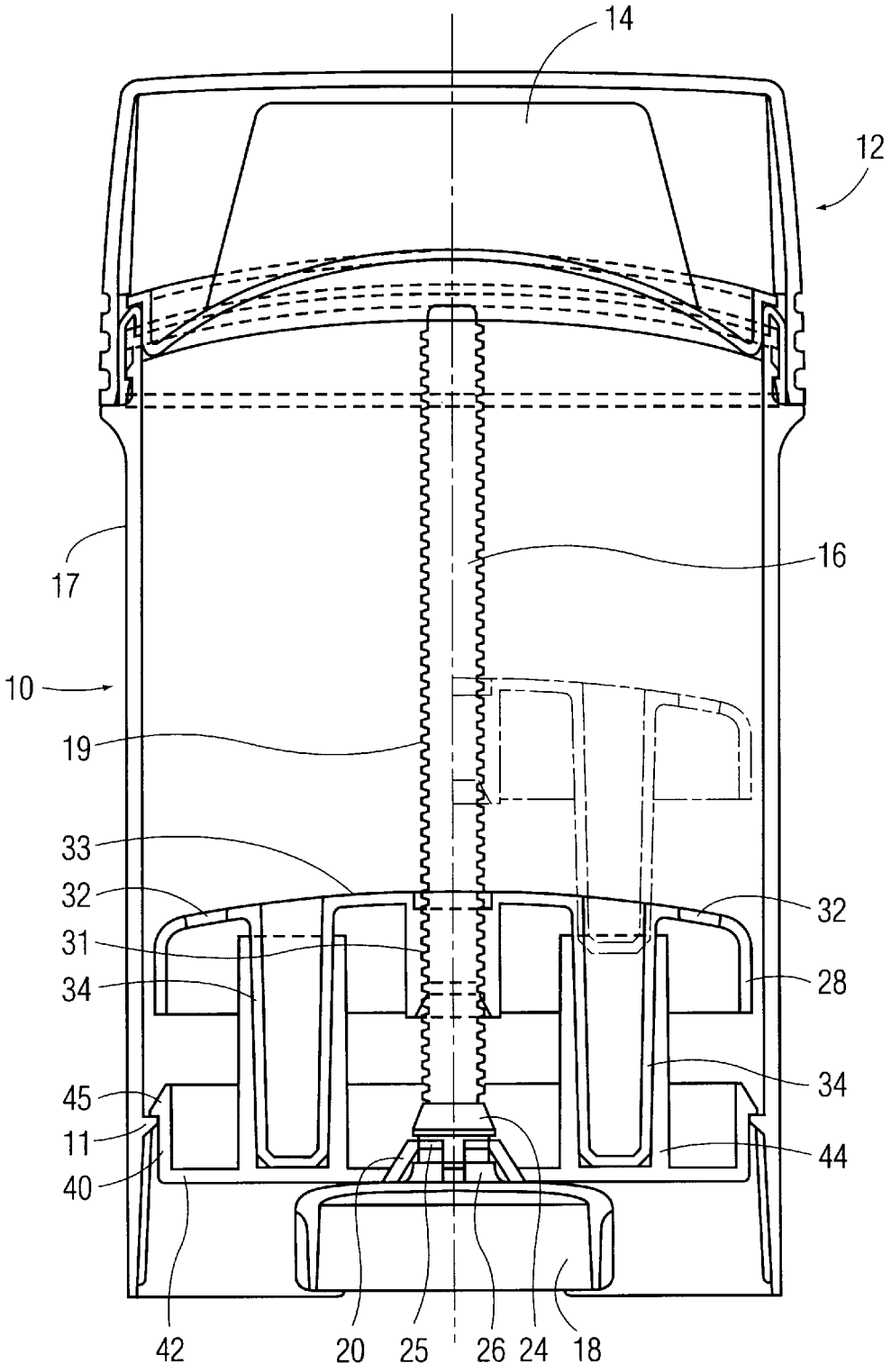
FIG. 1 is a front elevational view of a cosmetic container having a base portion and cosmetic holder with projections.

FIG. 1 is a front elevational view of a cosmetic container in cross-section. This figure shows projections on both the lower surface of the cosmetic holder and the upper surface of the base portion. These are shown in an interfitting arrangement, but this is not a requirement. There can be projections on only the cosmetic holder or on only the base portion. In addition in place of the base portion projections and cosmetic holder projections being of a different length to vary the distance of the cosmetic holder above the base portion these can be of the same length with either of these projections having vertical ribs on the surface of the projections that change the effective length of these projections when in an interfitting arrangement.

In FIG. 1 the cosmetic container 10 has a cap 12 and a lid 14. The lid 14 is primarily for shaping the cosmetic when the cosmetic container is filled from the bottom. It is not needed in a top fill arrangement. The consumer usually will discard the lid at the time of the first use of the cosmetic. The cosmetic container also has a cosmetic holder screw 16 which is supported by base portion 40. The cosmetic holder screw in turn supports elevator cosmetic holder 28. At the bottom of cosmetic holder screw 16 is knob 18 for turning the screw. The screw has circumferential flange 24 which is contacted by locking arms 20 which depend from base surface 42. These locking arms 20 fit in groove 25 formed between circumferential flange 24 and knob flange 26.

The base portion is locked into the barrel 17 by means of interlocking lip 11 on the barrel and lip 45 on the base portion. The base portion cannot move any further upwardly in the barrel since the knob flange 18 contacts the lower edge 21 of barrel 17 (see FIG. 2). Projections 44 extend upwardly from the base portion and will contact the projections 34 of cosmetic holder 28 when the cosmetic holder is retracted on screw 16. In the embodiment of FIG. 1 the cosmetic holder projections 34 are shown in an interfitting relationship fitting into base projections 44. This is preferred although is not necessary. In an additional embodiment, there need not be projections on both of the base portion and the cosmetic holder. Either base projections 34 or cosmetic holder projections 44 can be eliminated. If the cosmetic holder projections 34 are eliminated the base projections 44 will contact the lower surface of the cosmetic holder upon the full retraction of the cosmetic holder. If the base projections 44 are eliminated the cosmetic holder projections 34 will contact the upper surface of the base portion upon the full retraction of the cosmetic holder. In all of these embodiments, the length of the base projections and/or the cosmetic holder projections will determine the fill amount of the container.

Figure 2:
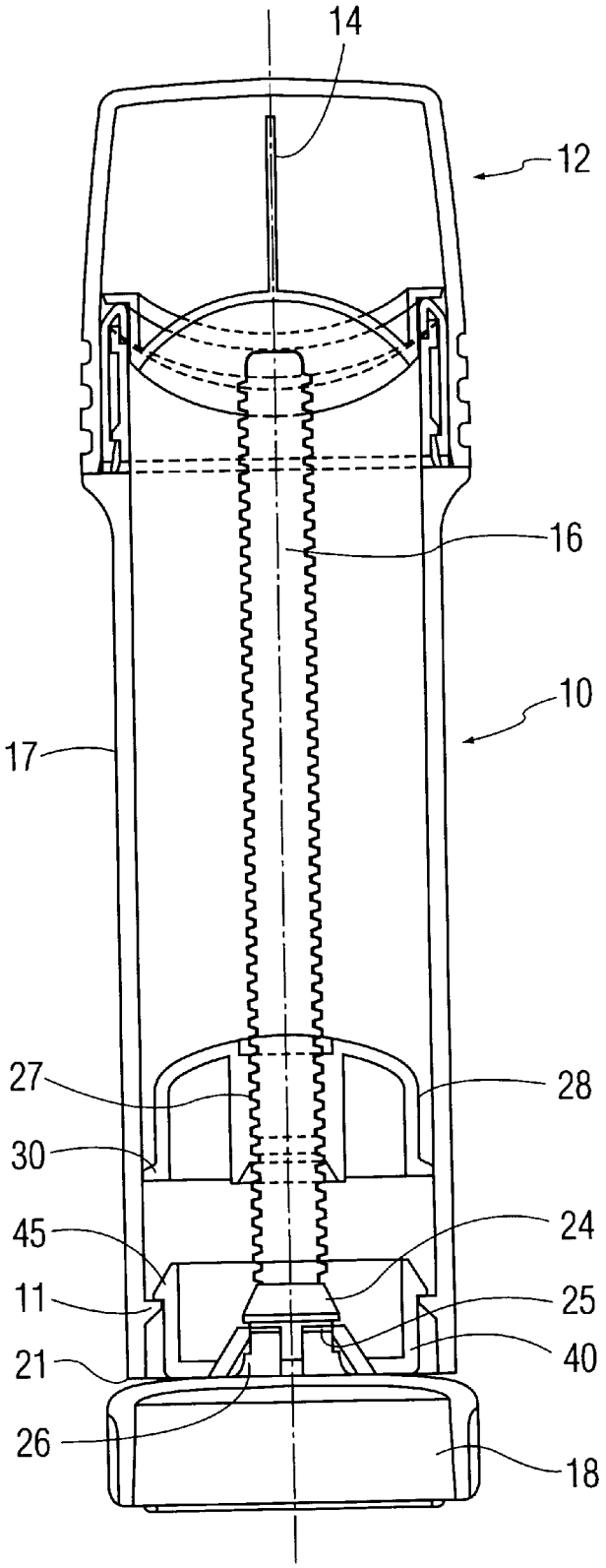
FIG. 2 is a side elevational view of the cosmetic container of FIG. 1.

FIG. 2 is a side view in cross-section of the cosmetic container of FIG. 1. The preferred shape of the cosmetic container is elliptical. There is seen here rib 30 which contacts the inner wall of barrel 17. The screw 16 has threads 19 and the cosmetic holder has mating threads. As the knob 18 is turned the screw rotates and the cosmetic holder 28 is raised and lowered.

Figure 3:
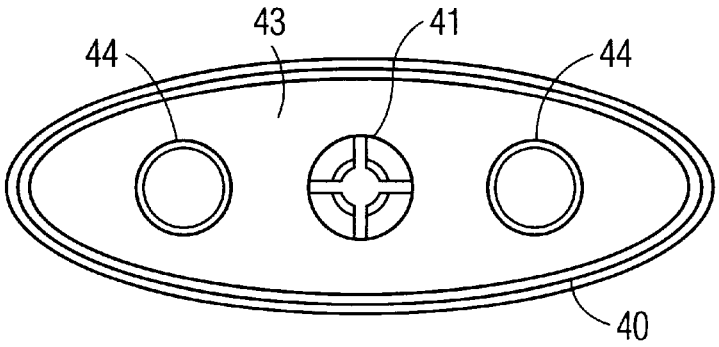
FIG. 3 is a top plan view of a base portion for the cosmetic container of FIG. 1.
Figure 4:
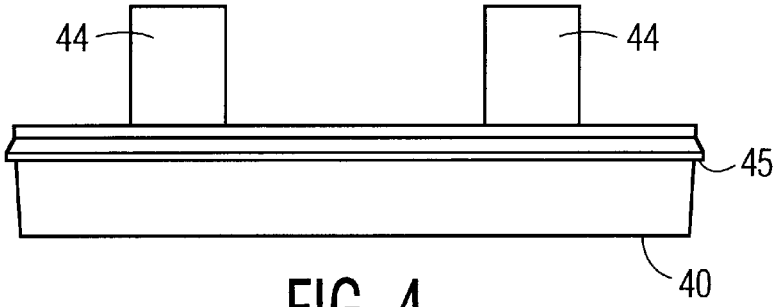
FIG. 4 is a side elevational view of one base portion of the cosmetic container of FIG. 1.
Figure 5:
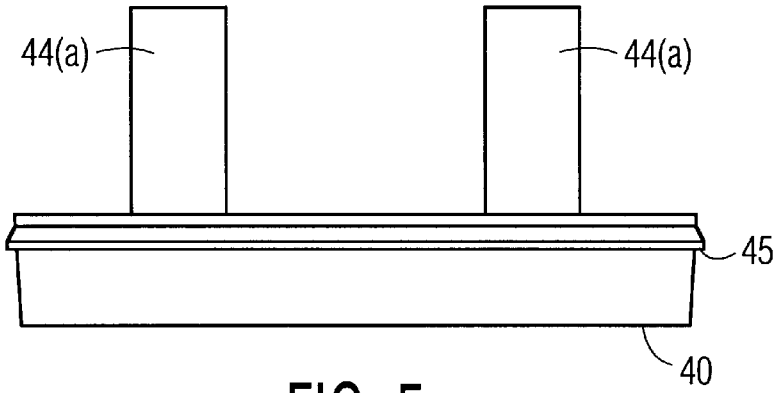
FIG. 5 is a side elevational view of another base portion of the cosmetic container of FIG. 1.

FIGS. 3, 4 and 5 are views of the base portion 40. FIG. 3 shows the top surface 43, aperture 41 to receive the screw 16 and projections 44. FIG. 4 is a side elevational view showing the projections 44 at a first length. In FIG. 5 the projections 44(*a*) are shown at a second length.

Figure 6:
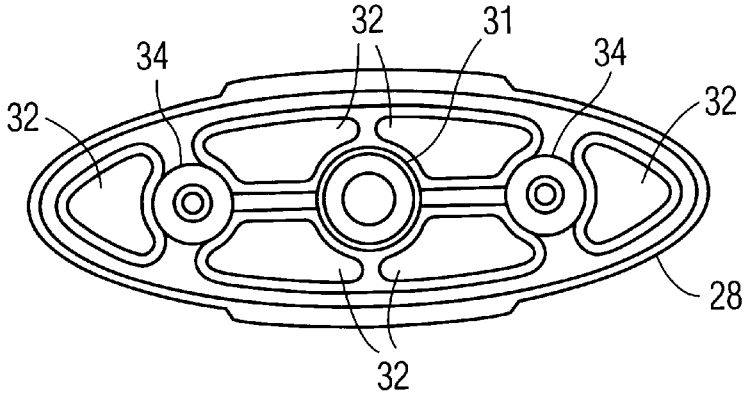
FIG. 6 is a top plan view of the cosmetic holder of the cosmetic container of FIG. 1.
Figure 7:
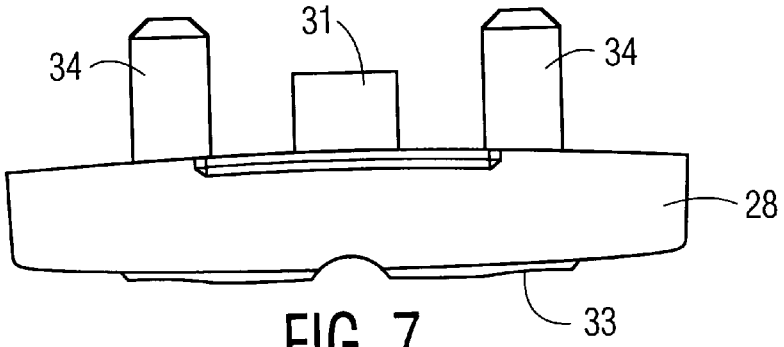
FIG. 7 is a side elevational view of one cosmetic holder of the cosmetic container of FIG. 1.
Figure 8:
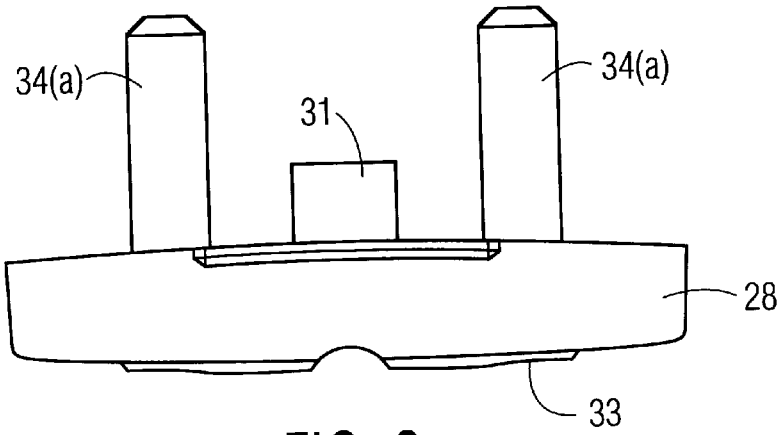
FIG. 8 is a side elevational view of another cosmetic holder of the cosmetic container of FIG. 1.

FIGS. 6, 7 and 8 show one version of the cosmetic holder 28 for the cosmetic container. FIG. 6 is a top view of the cosmetic holder showing aperture 31 to accept the screw 16 and projections 34. Apertures 32 are openings into which product to be supported on the cosmetic holder can flow to be locked onto the cosmetic holder. In FIG. 7 there is shown top surface 33 of the cosmetic holder with projections 34 extending from a lower surface. These projections are shown to be of a first length. In FIG. 8 these projections 34(*a*) are shown to be of a second length. When the cosmetic holder is fully retracted these projections will contact the surface of the base portion. This cosmetic holder is shown with apertures 32. There need not be any apertures in the surface of the cosmetic container. Also any prior art techniques can be used to anchor the product to the cosmetic holder.

Figure 9:
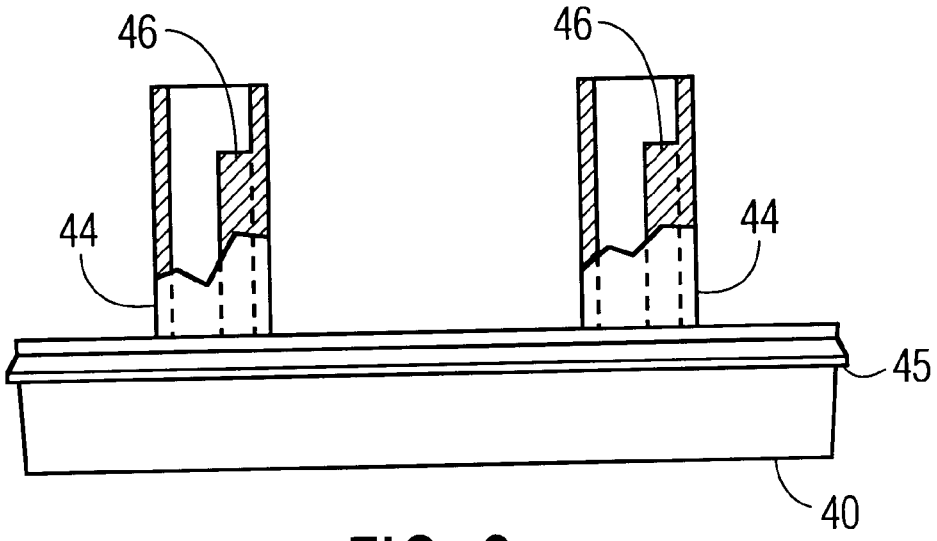
FIG. 9 is a side elevational view of the base portion in partial section showing internal ribs of a first length.
Figure 10:
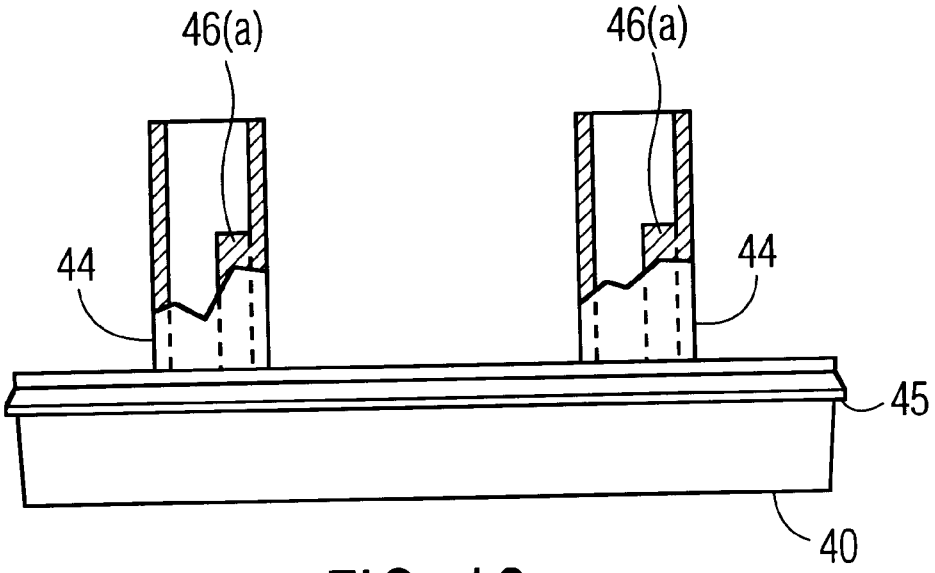
FIG. 10 is a side elevational view of the base portion in partial section showing internal ribs of a second length.
Figure 13:
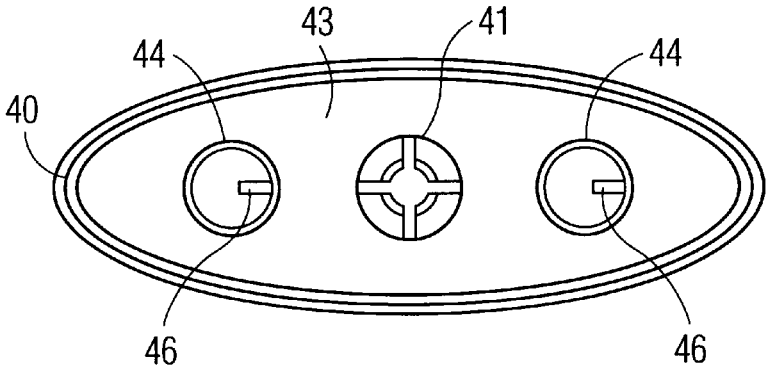
FIG. 13 is a top plan view of the cosmetic holder of FIG. 9.

FIGS. 9 and 10 show the base portion 40 with the projections 44 in a partial sectional to show internal ribs. Internal longitudinal ribs 46 and 46(*a*) are shown in this view with the ribs being of a differing length in FIGS. 9 and 10. FIG. 13 is a top plan view of the base portion of FIG. 9. The location of the internal ribs 46 is further shown in this view. The top plan view of the base portion of FIG. 10 would be similar to this view. When these base portions are used in conjunction with a cosmetic holder such as in FIG. 8, the cosmetic holder will fit into the base portion projections to different depths as determined by the length of the ribs on the base portion. Thus the effective length is different in FIG. 9 and in FIG. 10. In turn the distance of the cosmetic holder at full retraction to the top of the barrel is varied with a change in fill volume.

Figure 11:
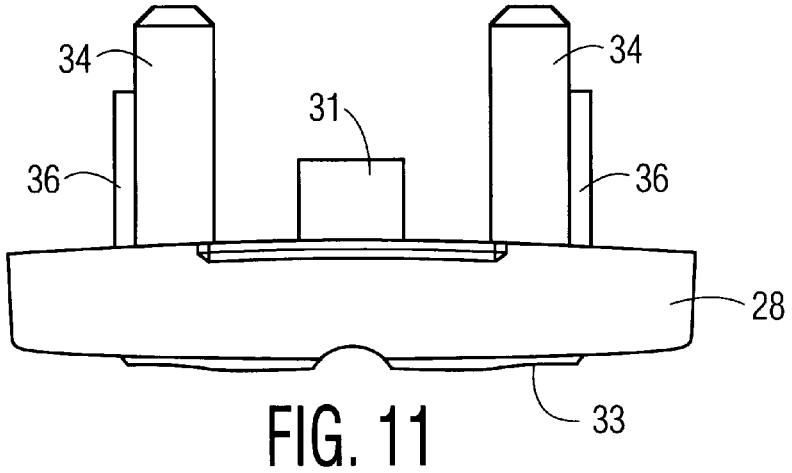
FIG. 11 is a side elevational view of the cosmetic holder showing ribs on the projections of a first length.
Figure 12:
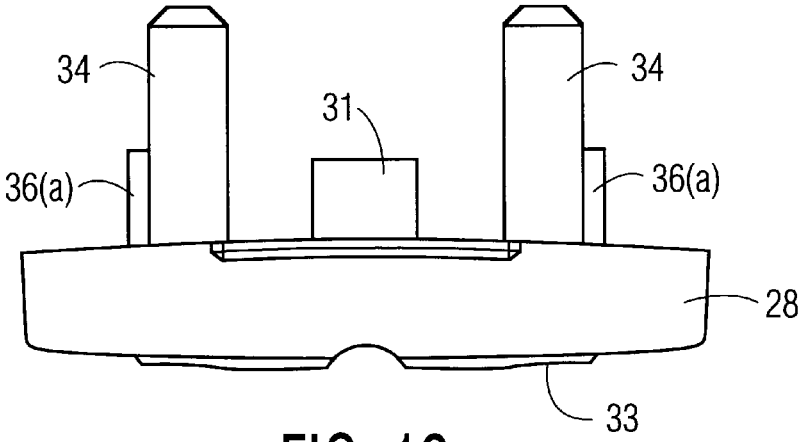
FIG. 12 is a side elevational view of the cosmetic holder showing ribs on the projections of a second length.

FIGS. 11 and 12 show the cosmetic holder with projections 34 having external ribs 36 and 36(*a*). These ribs also are shown in differing lengths. When these cosmetic holders are used in conjunction with a base portion as in FIG. 5 the cosmetic holder will fit into the base portion until the ribs 36 or 36(*a*) contact the top of projections 34. The length of the ribs will determine the distance between the base portion and cosmetic holder and the fill amount between the cosmetic holder at full retraction and the top of the barrel. That is the ribs 36 or 36(*a*) determine effective length of the base portion projections and the cosmetic holder projections.

The base portions of FIGS. 9 and 10 and the cosmetic holders of FIGS. 11 and 12 can be used in the cosmetic container of FIG. 1. All of the base portions and cosmetic holders can be used with the barrel and other cosmetics container parts shown in FIG. 1.

In the embodiments of FIGS. 1 to 8 and the embodiments of FIGS. 9 to 13 the effective length of the cosmetic holder projections or the base projections is adjusted. This can be by the use of projections of differing length on the cosmetic holder or base portion or by the use of ribs of varying length on the cosmetic holder projections or the base portion projections. The net result is the same. The distance between the cosmetic holder and base portion at the full retraction of the cosmetic holder can be set. This in turn sets the volume of product in the cosmetic container since it varies the space between the cosmetic holder at full retraction and the top of the barrel. The fill amount is the amount of product between the cosmetics holder and the top of the barrel.

When a cosmetic container is to be top filled the screw, cosmetic holder and base portion are assembled with the base portion and cosmetic holder having projections of an effective height to provide the desired fill amount when the cosmetic holder is fully retracted. For top filling the cosmetic holder is fully retracted on the screw and the assembly of the screw, cosmetic holder and base portion is inserted into a barrel. The barrel then is filled with the product in a flowable condition. For bottom filling the lid and cap are placed on the barrel, the barrel inverted and filled with the desired amount of product. The base assembly then is inserted into the barrel. For top filling the cosmetic container is upright and filled through the top of the barrel.

As discussed, the same molds are used to make the barrels, base portions, screw and cosmetic holder. For different fill amounts only the effective height of the projections or the ribs on the projections are changed, and this is done by the use of different mold parts such as pins or sleeves. Different molds are not needed. Various modifications of this concept are possible. However, each would be within the bounds of the present discovery.

The parts can be made from any conventionally used plastic. This includes thermoplastics and thermoset resins. These includes polyethylene, polypropylene, polystyrene, and styrene-butadiene polymers for the barrel and the screw and polyethylene and polypropylene for the base portion and the cosmetic holder. There is no restriction to any particular materials. Any materials commonly used for cosmetics containers can be used.

What is claimed is:

1. A cosmetic container comprising:

a non-circular barrel portion and a selected base portion secured to one end of said barrel portion;

an elevating means rotatably secured to said selected base portion and extending upwardly into said barrel portion;

a selected cosmetic holder adjustably supported on said elevating means for movement upwardly and downwardly in said barrel portion upon the activation of said elevating means;

at least one of said selected base portion and said selected cosmetic holder having at least one projection and the other having at least one recess;

said selected base portion having one of at least one projection and at least one recess on an upper surface thereof and said selected cosmetic holder having one of a least one projection and at least one recess on a lower surface, when said selected base portion has at least one projection said cosmetic holder has at least one recess and when said selected base portion has at least one recess said cosmetic holder has at least one projection, each of said at least one projection being in alignment with each of said at least one recess so as to interfit one into the other;

one of said at least one projection and of said at least one recess having a longitudinal rib thereon extending at least partially the length thereof to form the effective length thereof;

whereby upon rotation of said elevating means said cosmetic holder can be moved downwardly towards said selected base portion with said at least one projection and said at least one recess on one of said selected base portion and said selected cosmetic holder interfitting one into the other to a point of contact with said longitudinal rib which stops the movement of said at least one cosmetic holder toward said at least one base portion and thereby sets the distance of said at least one cosmetic holder to a top of said barrel portion and the amount of material that can be placed into said barrel portion above said at least one cosmetic holder.

2. A cosmetic container as in claim 1 wherein said at least one base portion has at least one base projection on the upper surface thereof and said cosmetic holder has said at least one recess on a lower surface thereof.

3. A cosmetic container as in claim 2 wherein said longitudinal rib is on a surface of said at least one projection.

4. A cosmetic container as in claim 2 wherein said longitudinal rib is on an interior surface of said at least one recess.

5. A cosmetic container as in claim 1 wherein said at least one base portion has said at least one recess on the upper surface thereof and said cosmetic holder has said at least one projection on the lower surface thereof.

6. A cosmetic container as in claim 5 wherein said longitudinal rib is on a surface of said at least one projection.

7. A cosmetic container as in claim 5 wherein said longitudinal rib is on an interior surface of said at least one recess.

8. A method of adjusting the amount of a cosmetic within a cosmetic container which is comprised of a non-circular barrel portion, at least one base portion secured to one end of said barrel portion and an elevating means secured to said at least one base portion and extending upwardly into said barrel portion comprising:

providing a plurality of base portions having one of at least one upwardly extending base projection and at least one recess, at least one of said at least one upwardly extending base projection and said at least one base recess having a longitudinal rib extending at least partially along a surface thereof, said longitudinal rib determining the effective length thereof;

selecting a base portion with an effective length of one of said at least one upwardly extending base projection and said at least one base recess to provide a given amount of said cosmetic within said barrel portion when said cosmetic container is filled with said cosmetic;

providing a cosmetic holder that is longitudinally adjustable within said barrel portion said cosmetic holder having one of at least one cosmetic holder projection and at least one cosmetic holder recess aligned to at least partially interfit with one of said at least one upwardly extending projection and said at least one base recess of a selected base portion;

retracting said cosmetic holder until one of said at least one cosmetic holder projection and said at least one cosmetic holder recess at least partially interfits with one of said at least one upwardly extending base projection and said at least one base recess of said at least one base portion and further retraction is prevented, and in either order (a) inserting said at least one base portion with said cosmetic holder into said barrel portion; and (b) filling said barrel portion of said cosmetic container with said cosmetic.

9. A method as in claim 8 wherein said at least one base projection has a longitudinal rib thereon of a length less than that of said base projection.

10. A method as in claim 9 wherein said cosmetic holder has at least one downwardly extending cosmetic holder projection in alignment with said at least one upwardly extending base projection, and interfitting said at least one downwardly extending cosmetic holder projection with said at least one upwardly extending base projection until said cosmetic holder projection contacts said longitudinal rib.

11. A method as in claim 8 wherein said at least one base portion has at least two upwardly extending base projections, each having a longitudinal rib thereon, said cosmetic holder has at least two cosmetic holder recesses, and interfitting said at least two cosmetic holder recesses with said at least two upwardly extending base projections of said selected base portion.

12. A method as in claim 8 wherein there are at least two base portions each having at least one upwardly extending base projection, the upwardly extending base projection of one base portion being of a different length from the upwardly extending projection of another base portion, and selecting a base portion to provide a predetermined fill level in said barrel portion of said cosmetic container.

13. A method as in claim 8 wherein said at least one base portion has at least two recesses, each having said longitudinal rib on an inner surface thereof, said cosmetic holder has at least two cosmetic holder projections, and interfitting said at least two cosmetic holder projections onto said at least two base portion projections.

14. A method as in claim 8 wherein said at least one base portion has at least two upwardly extending base projections, said cosmetic holder has at least two cosmetic holder recesses each having said longitudinal rib thereon, and interfitting said at least two cosmetic holder recesses with said at least two upwardly extending base projections of said base portion.

15. A method as in claim 8 wherein said at least one base portion has at least two recesses said cosmetic holder has at least two cosmetic holder projections each having said longitudinal rib thereon, and interfitting said at least two base portion recesses of said base portion.

16. A method of adjusting the amount of cosmetic in a cosmetic container which is comprised of a non-circular barrel portion, a base portion secured to one end of said barrel portion and an elevating means secured to said base portion and extending upwardly into said barrel portion comprising:

providing a plurality of cosmetic holders adjustably mountable on said elevating means, said plurality of cosmetic holders having one ot at least one downwardly extending cosmetic holder projection and one cosmetic holder recess, each having a longitudinal rib of a predetermined length extending at least partially along a surface thereof to form an effective length thereof and aligned with one of at least one upwardly extending base projection and at least one base recess of said base portion;

selecting a cosmetic holder from said plurality of cosmetic holders to provide a given amount of said cosmetic within said barrel portion when said cosmetic container is filled with said cosmetic; and retracting said cosmetic holder on said elevating means until one of said cosmetic holder projection and said at least one cosmetic holder recess at least partially interfits with one of one of said at least one upwardly extending base projection and said at least one base recess of said at least one base portion and further retraction is prevented: and in either order (a) inserting said base portion with said at least one cosmetic holder into said barrel portion;

(b) filling said barrel portion of said cosmetic container with a cosmetic.

17. A method as in claim 16 wherein said at least one cosmetic holder projection has a longitudinal rib thereon of less than the length of said at least one cosmetic holder projection whereby said rib contacts a part of said base portion when said at least one cosmetic holder is retracted.

18. A method as in claim 16 wherein there are at least two cosmetic holders, each of said at least two cosmetic holders having at least one downwardly extending cosmetic holder projection, said downwardly extending projection of one cosmetic holder of said at least two cosmetic holders being of a different length form the downwardly extending cosmetic holder projection of another cosmetic holder, and selecting a cosmetic holder of said at least two cosmetic holders to provide a predetermined fill level in said cosmetic container.

* * * * *